United States Patent [19]

Wakamatsu et al.

[11] Patent Number: 4,839,015

[45] Date of Patent: Jun. 13, 1989

[54] HYDROGEN-EVOLUTION ELECTRODE AND A METHOD OF PRODUCING THE SAME

[75] Inventors: Hisashi Wakamatsu; Yasuhide Noaki, Nobeoka, both of Japan

[73] Assignee: Asahi Kasei Kogyo Kabushiki Kaisha, Osaka, Japan

[21] Appl. No.: 166,805

[22] Filed: Mar. 3, 1988

Related U.S. Application Data

[63] Continuation of Ser. No. 916,647, Oct. 8, 1986, abandoned.

[30] Foreign Application Priority Data

Oct. 9, 1985 [JP] Japan ..... 60-225424

[51] Int. Cl.[4] ..... C25B 11/04

[52] U.S. Cl. ..... 204/290 R; 204/291

[58] Field of Search ..... 204/290 R, 291, 292, 204/293, 129, 98

[56] References Cited

U.S. PATENT DOCUMENTS

| | | | |
|---|---|---|---|
| 4,055,476 | 10/1977 | Benezra et al. | 204/98 |
| 4,105,516 | 8/1978 | Martinsons et al. | 204/98 |
| 4,243,497 | 1/1981 | Nicolas et al. | 204/98 |
| 4,255,247 | 3/1981 | Oda et al. | 204/293 |
| 4,358,353 | 11/1982 | Bommaraju et al. | 204/98 |
| 4,394,231 | 7/1983 | Nicolas | 204/129 |
| 4,414,064 | 11/1983 | Stachurski et al. | 204/290 R |
| 4,422,920 | 12/1983 | Stachurski et al. | 204/290 R |
| 4,426,269 | 1/1984 | Brown et al. | 204/242 |
| 4,436,599 | 3/1984 | Bissot et al. | 204/98 |
| 4,447,302 | 5/1984 | Brennecke et al. | 204/128 |
| 4,605,484 | 8/1986 | Shiroki et al. | 204/290 R |

FOREIGN PATENT DOCUMENTS 60-26682 2/1985 Japan .

*Primary Examiner*—John F. Niebling
*Assistant Examiner*—Ben C. Hsing
*Attorney, Agent, or Firm*—Birch, Stewart, Kolasch & Birch

[57] ABSTRACT

A hydrogen-evolution electrode comprising an electrically conductive substrate having thereon a coating comprising a chromium component, a titanium component and an oxide of at least one metal selected from the group consisting of nickel and cobalt, said chromium component and titanium component being present in proportions, in terms of atomic percentage, of 0.5 to 40% and 0.1 to 10%, respectively. The titanium component retards the dissolution rate of the chromium component. Accordingly, the electrode has a life several times as long as that of the conventional electrodes, and can exhibit an advantageously low hydrogen overvoltage for a prolonged period of time. Also, the electrode can be advantageously employed to produce an alkali product improved in purity. Such a hydrogen-evolution electrode can be produced by melt-spraying onto a substrate a mixture of a finely divided powder of at least one member selected from the first group consisting of nickel, nickel compounds, cobalt and cobalt compounds, a finely divided powder of at least one member selected from the second group consisting of chromium and chromium compounds and a finely divided powder of at least one member selected from the third group consisting of titanium and titanium compounds. In the production, when the above-mentioned mixture is subjected to granulation and the obtained granules are melt-sprayed, there can be obtained the desired electrode having excellent properties with respect to catalytic activity and durability in high spraying yield.

4 Claims, 4 Drawing Sheets

Fig. 1-(A)
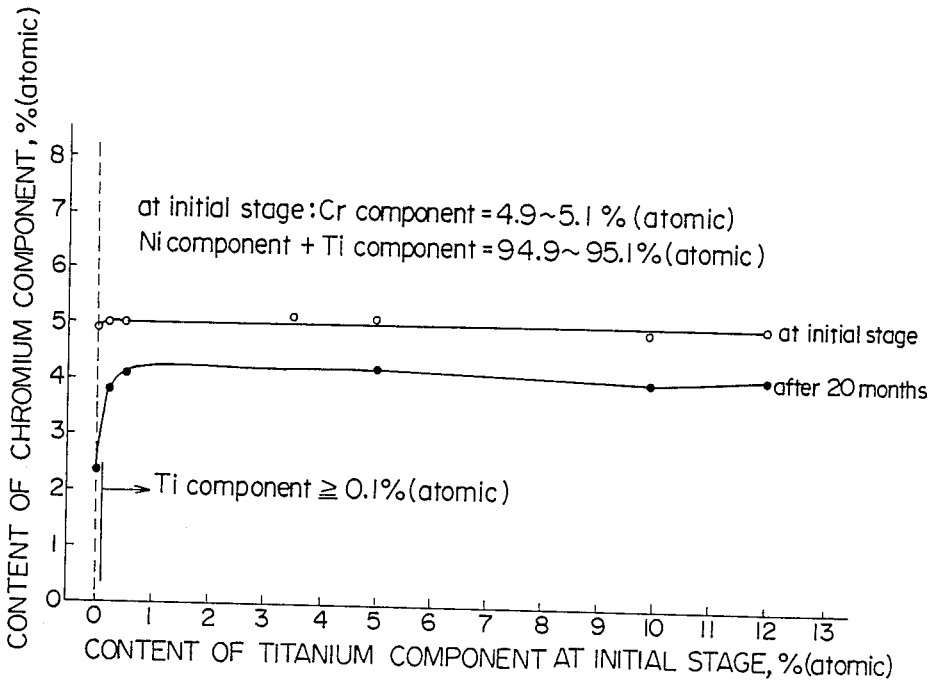

Fig. 1-(B)
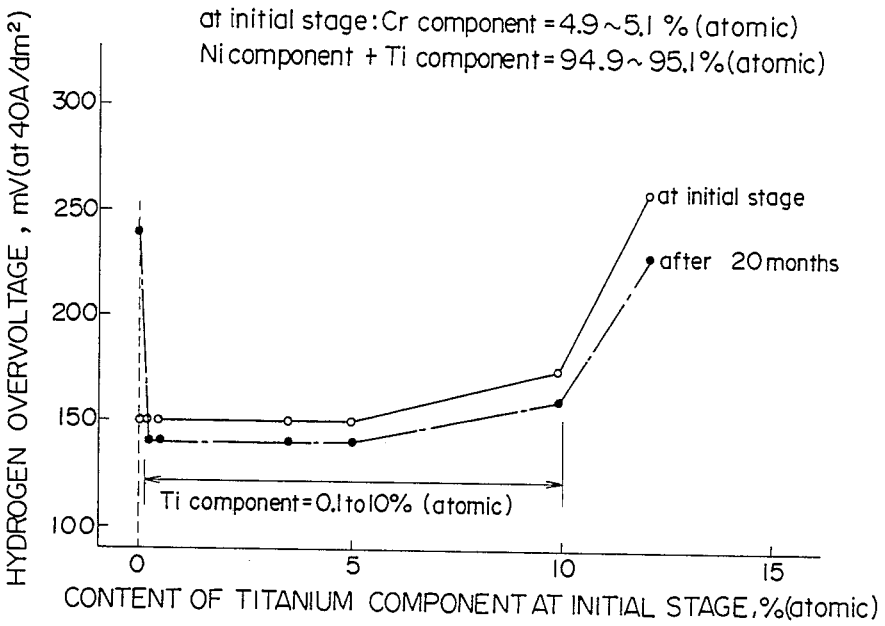

measuring conditions

| | |
|---|---|
| Target | Co |
| kV-mA | 29-10 |
| Filter | Fe |
| Full Scale | $1 \times 10^3$ c/s |
| Time Const. | 2 sec |
| Scan. Speed | 1°/min |
| Chart Speed | 1cm/min |
| Detector | S.C. |

HYDROGEN-EVOLUTION ELECTRODE AND A METHOD OF PRODUCING THE SAME

This application is a continuation, of application Ser. No. 916,647 filed on Oct. 8, 1986, abandoned.

BACKGROUND OF THE INVENTION

1. Field of the Invention

This invention relates to an improved hydrogen-evolution electrode and a method of producing the same. More particularly, the present invention is concerned with an electrode having a coating comprised of an oxide of at least one metal selected from nickel and cobalt, which coating additionally contains chromium and titanium components in specific proportions. The electrode may be used to conduct electrolysis of sodium chloride or water, during which electrolysis evolution of hydrogen occurs on the electrode in an alkaline solution. The electrode not only advantageously exhibits a low hydrogen overvoltage and high stability for a prolonged period of time but also is available at low cost. Also, the present invention is concerned with a method of producing such an improved hydrogen-evolution electrode.

2. Discussion of Related Art

To attain energy cost saving, researches have been made in the electrolysis industry with respect to electrodes. Especially, intensive efforts have been made to develop an active electrode which exhibits a low hydrogen overvoltage, thereby enabling the superfluous consumption of energy by the hydrogen overvoltage to be decreased. Various proposals have been made to provide an active electrode exhibiting a low hydrogen overvoltage for a prolonged period of time. For example, it was proposed to form an active coating on an electrically conductive substrate by applying an electrode catalyst onto the surface of the substrate by an electroplating method, a chemical plating method, a method comprising applying a coating solution followed by a baking of the solution, a melt-spraying method or the like. It was also proposed to further subject the active coating to heat treatment, or to increase the surface area of the coating by leaching out the soluble sacrificial metal component contained in the coating.

As the above-mentioned electrode catalyst for lowering the overvoltage, investigations have been made to use transition metals, noble metals, combinations of these metals, and combinations of these metal components and sacrificial metal components.

Generally, the heretofore proposed electrodes can be classified into those in which a metal, an alloy or a mixture thereof is used as an active material, and those in which a metal oxide, a compound oxide or a mixture of metal oxides is used as an active material.

The electrodes in which a metal, an alloy or a mixture thereof is used as an active material have a fatal inherent disadvantage in that when an electrolysis is continuously effected using the above-mentioned type of electrode as a hydrogen-evolution electrode, the hydrogen overvoltage of the electrode increases with the lapse of time, and the activity of the electrode is lost. Moreover, the electrode of the above type has another disadvantage that, in the electrolysis of a sodium chloride solution according to the ion exchange membrane method using the above-mentioned type of electrode, a metal component of the electrode dissolves out of the electrode by corrosion or the electrode comes into a passive state by oxidation due to the reverse current occurring at the time of stopping of the electrolysis, whereby the life of the electrode becomes short.

As electrodes eliminating the above-mentioned disadvantages of the electrode of which the active material is a metal, an alloy or a mixture thereof, the electrodes in which a metal oxide, a compound oxide or a mixture of metal oxides is used as an active material have been proposed.

For example, there has been proposed a hydrogen-evolution electrode having on its surface a coating comprising an oxide of at least one metal selected from the group consisting of nickel, cobalt and silver, and a process for preparing the same (see U.S. Pat. No. 4,496,453). This electrode in which the above metal oxide is used as an active material can maintain activity for a prolonged period of time as compared with the electrodes in which a metal, an alloy or a mixture thereof is used as an active material. However, it still has a disadvantage that, from the viewpoint of an industrially useful electrode, the period in which the electrode can maintain activity is not sufficient. The reason is that the metal oxide is gradually reduced to a metal due to the continuous hydrogen-evolution reaction, thereby causing the hydrogen overvoltage to increase with the lapse of time as in the case of the electrode in which a metal, an alloy or a mixture thereof is used as an active material.

Further, there has been proposed a hydrogen-evolution electrode produced by applying, according to a melt-spraying method, onto an electrically conductive substrate a coating comprised of a titanium component and an oxide of at least one metal selected from the group consisting of nickel and cobalt, which titanium component is contained in the coating in a proportion of 0.5 to 20% in terms of atomic percent age (see Japanese Patent Application Laid-Open Specification No. 60-26682/1985). This electrode is characterized by incorporation of a titanium component into the coating to prevent the metal oxide from being reduced to a metal. The durability of the electrode is improved to some extent as compared with the conventional electrodes. However, it still has disadvantages that from an industrial point of view, the durability is not sufficient, and that the lowering of the hydrogen overvoltage becomes insufficient with the increase of the Ti content.

U.S. Pat. No. 4,605,484 (one of the inventors is also one of the present inventors) discloses a hydrogen-evolution electrode comprised of an electrically conductive substrate having thereon a coating layer comprising a chromium component and an oxide of at least one metal selected from the group consisting of nickel and cobalt, which chromium component is present in a proportion of 0.5 to 20% in terms of atomic percentage. In the specification of the U.S. patent, there is a description to the effect that in order to prevent the nickel oxide and/or cobalt oxide in the coating layer from being reduced, it is effective to incorporate therein a component selected from the group consisting of chromium, vanadium, titanium, manganese and niobium, preferably chromium or titanium, more preferably chromium. The proposed electrode in which chromium is used for the purpose of preventing the metal oxide from being reduced is considerably improved with respect to lowering of the hydrogen overvoltage and maintenance of the activity of the electrode for a prolonged period of time. However, the improvements are not sufficient. The present inventors have investigated why the activity of the electrode in which chromium is incorporated is decreased when the electrolysis is conducted for a prolonged period of time. As a result, it has been found that if an electrode in which chromium is incorporated for the purpose of preventing the metal oxide from being reduced is used as a hydrogen-evolution electrode in the electrolysis of an aqueous alkaline solution for a prolonged period of time, the chromium is gradually dissolved into the alkaline solution to lower the chromium content in the coating layer, thereby causing the metal oxide to be reduced to a metal and hence the overvoltage to increase with the lapse of time.

As a result of the extensive and intensive studies, the present inventors have unexpectedly found that the rate of dissolution of the chromium into an alkaline solution can be greatly reduced by further incorporating a titanium component into the coating layer containing a chromium component and an oxide of at least one metal selected from the group consisting of nickel and cobalt. This unexpected finding has enabled us to complete the present invention.

SUMMARY OF THE INVENTION

It is, therefore, an object of the present invention to provide a hydrogen-evolution electrode which is capable of exhibiting a low hydrogen overvoltage for a prolonged period of time as compared with the conventional electrodes and which is improved in respect of contamination of the electrolytic solution by a chromium ion.

It is another object of the present invention to provide a method of producing a hydrogen-evolution electrode of the kind mentioned above, which method can be performed with ease and high productivity.

The foregoing and other objects, features and advantages of the present invention will be apparent to those skilled in the art from the following detailed description and appended claims taken in connection with the accompanying drawings in which:

BRIEF DESCRIPTION OF THE DRAWINGS

FIG. 1-(A) is a graph showing the changes in content of a chromium component in an electrode coating comprising a nickel oxide, chromium and titanium between the start and the end of electrolysis continuously carried out in an aqueous 30% caustic soda solution at a current density of 40 A/dm$^2$ at 20° C. for 20 months, when the initial content of titanium in the coating is varied while the initial content of chromium is set at 4.9 to 5.1% in terms of atomic percentage;

FIG. 1-(B) is a graph showing the changes in hydrogen overvoltage, with respect to an electrode having a coating comprising a nickel oxide, chromium and titanium, between the start and the end of electrolysis continuously carried out in an aqueous 30% caustic soda solution at a current density of 40 A/dm$^2$ at 90° C. for 20 months, when the initial content of titanium in the coating is varied while the initial content of chromium is set at 4.9 to 5.1% in terms of atomic percentage;

DETAILED DESCRIPTION OF THE INVENTION

In one aspect of the present invention, there is provided a hydrogen-evolution electrode comprising an electrically conductive substrate having thereon a coating comprising a chromium component, a titanium component and an oxide of at least one metal selected from the group consisting of nickel and cobalt, said chromium component and titanium component being present in proportions, in terms of atomic percentage, of 0.5 to 40% and 0.1 to 10%, respectively, said atomic percentage of chromium being defined by the following formula $$\frac{A_{Cr}}{A_T} \times 100(\%) \quad (1)$$

wherein $A_{Cr}$ represents the number of chromium atoms in the coating and $A_T$ represents the total number of atoms of chromium, titanium and said at least one metal in the coating, said atomic percentage of titanium being defined by the following formula $$\frac{A_{Ti}}{A_T} \times 100(\%) \quad (2)$$

wherein $A_{Ti}$ represents the number of titanium atoms in the coating and $A_T$ is as defined above.

As described hereinabove, the coating of the electrode according to the present invention comprises an oxide of at least one metal selected from the group consisting of nickel and cobalt, a chromium component and a titanium component. The oxide of at least one metal selected from the group consisting of nickel and cobalt in the coating enables the electrode to have a high catalytic activity, that is, enables the electrode to exhibit a low hydrogen overvoltage. The chromium component in the coating of the electrode imparts a reduction resistance to the oxide contained as an active material in the coating. The term "reduction resistance" used herein is intended to mean such a property that the oxide as an active material in the electrode coating is not reduced and remains as an oxide even after the continuous operation of electrolysis involving a hydrogen-evolution reaction On the other hand, the titanium component in the coating of the electrode retards the dissolution rate of the chromium, which has a reduction resistance as mentioned above, into an alkaline solution It is not yet elucidated in what manner the titanium exerts such an effect. However, it is due to the effect exerted by the titanium component that the electrode according to the present invention has a life several times as long as that of the conventional electrodes and serves as an active cathode which can produce an alkali without the problem of contamination.

Figure 2:
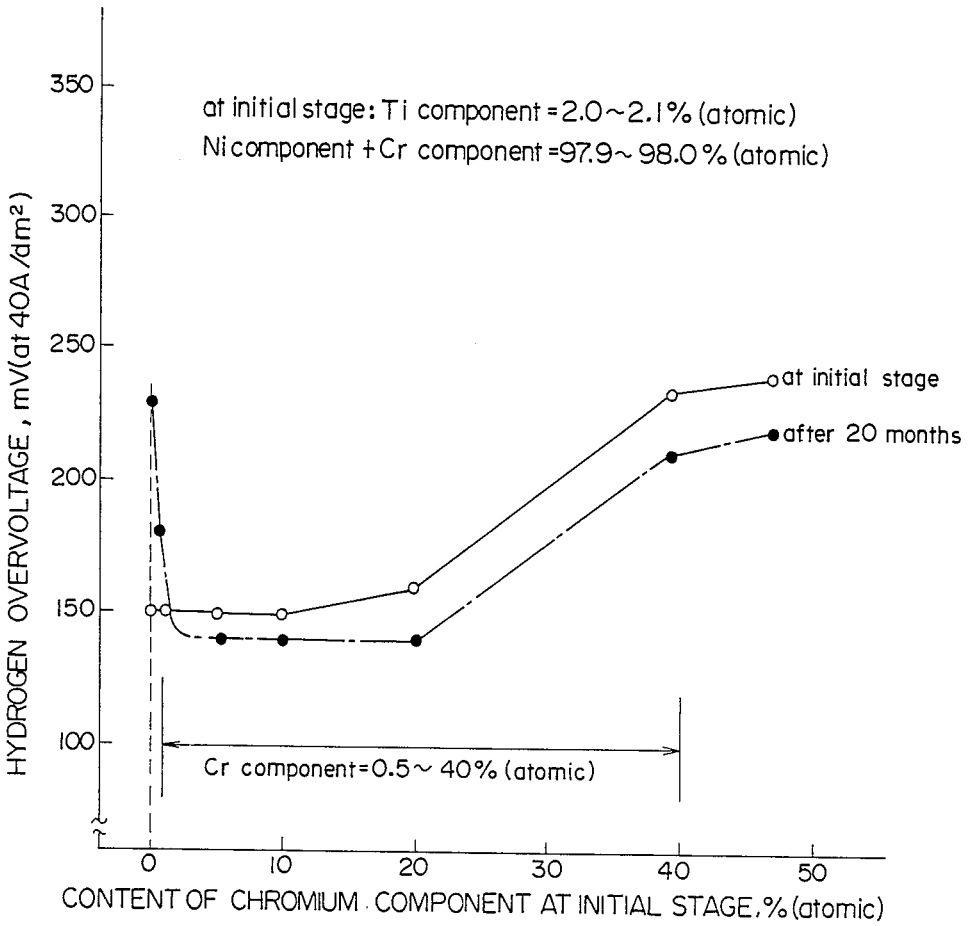
FIG. 2 is a graph showing the changes in hydrogen overvoltage, with respect to an electrode having a coating comprising a nickel oxide, chromium and titanium between the start and the end of electrolysis continuously carried out in an aqueous 30% caustic soda solution at a current density of 40 A/dm$^2$ at 90° C. for 20 months, when the initial content of chromium in the coating is varied while the initial content of titanium is set at 2.0 to 2.1% in terms of atomic percentage.

With respect to the above-described effect of the titanium component and the advantageous properties of the present electrode, reference may be made to FIG. 1(A), FIG. 1(B) and FIG. 2 of the accompanying drawings.

FIG. 1 (A) shows that with respect to an electrode having a coating comprised of a nickel oxide, a chromium component and a titanium component in specific proportions according to the present invention, the decrease of the chromium component of the electrode is advantageously low even after the electrode is continuously employed for hydrogen evolving electrolysis as long as 20 months. From this, it is understood that with respect to the above electrode according to the present invention, the titanium component retards the dissolution rate of the chromium component. Due to the retardation of the dissolution rate of the chromium component, the electrode having a coating comprised of a nickel oxide, a chromium component and a titanium component in specific proportions according to the present invention advantageously keeps the hydrogen overvoltage low even after 20 months of electrolysis, as is shown in FIG. 1 (B). It is noted that by contrast, an electrode having a coating comprised of a nickel oxide and a chromium component, not containing any titanium component, exhibits a disadvantageous increase in hydrogen overvoltage by employment thereof in the electrolysis for a period of 20 months. Moreover, as is illustrated in FIG. 2, an electrode having a coating comprised of a nickel oxide and a titanium component, not containing any chromium component, also exhibits a disadvantageous increase in hydrogen overvoltage by employment thereof in the electrolysis for a period of 20 months. From the foregoing, it is apparent that the electrode having a coating comprised of a nickel oxide, a chromium component and a titanium component in specific proportions according to the present invention is an extremely advantageous electrode.

In the present invention, the coating of an electrode contains a titanium component in a proportion, in terms of atomic percentage as defined by the formula (2), of 0.1 to 10%. To effectively retard the dissolution rate of the chromium component, it is needed that the content of the titanium component in the coating be 0.1% or more, preferably 0.2% or more. For most effectively retarding the dissolution rate of the chromium component, it is preferred that the content of the titanium component in the coating be 0.5% or more. On the other hand, an electrode having a coating containing a titanium component in a proportion of more than 10% is disadvantageous because it exhibits a high hydrogen overvoltage. To attain an especially low hydrogen overvoltage, it is preferred that the coating of the electrode contain a titanium component in a proportion of 5% or less. Further, it is more preferred that the content of the titanium component be 3.5% or less to avoid the possibility of decreases in mechanical strength of the coating and bonding strength between the coating and the substrate which decreases may occur when electricity is passed through the electrode.

In the present invention, the coating of an electrode contains a chromium component in a proportion, in terms of atomic percentage as defined by the formula (1), of 0.5 to 40%. When the content of a chromium component in the coating of an electrode is less than 0.5%, the reduction resistance of the oxide in the coating is low so that the degree of oxidation in the coating is considerably decreased within a short period of time of electrolysis, causing the activity of the electrode to be lost to increase the hydrogen overvoltage. On the other hand, when the content of a chromium component in the coating of an electrode is more than 40%, the reduction resistance of the oxide in the coating is so high that the degree of oxidation of the coating is hardly decreased. However, in this case, the activity of the electrode is low even at the initial stage of electrolysis and the effect of lowering the hydrogen overvoltage cannot be attained. In the electrode of the present invention of which the coating contains a chromium component in a proportion, in terms of atomic percentage as defined by the formula (1), of 0.5 to 20%, even after the electrode is continuously used in an electrolysis involving a hydrogen-evolution reaction over a prolonged period of time, the electrode preferably exhibits an extremely low hydrogen overvoltage.

The content of a titanium component in the coating of an electrode (hereinafter often referred to as "titanium component content") as used herein means a percentage of the number of titanium atoms in the coating relative to the total number of atoms of titanium, chromium and at least one metal selected from nickel and cobalt in the coating. The content of the titanium component is determined by first mixing an aliquot of the coating with a flux, next melting the resulting mixture, subsequently adding hot water and aqueous sulfuric acid thereto, and then subjecting the thus obtained homogeneous solution to an atomic absorption analysis, as described later. Likewise, the content of a chromium component in the coating of an electrode (hereinafter often referred to as "chromium component content") as used herein means a percentage of the number of chromium atoms in the coating relative to the total number of atoms of titanium, chromium and at least one metal selected from nickel and cobalt in the coating. The content of the chromium component is determined according to substantially the same procedures as mentioned above with respect to the determination of the content of the titanium component.

An oxide of at least one metal selected from the group consisting of nickel and cobalt contained in the coating of the present invention may be nickel oxide, cobalt oxide a mixture thereof, or a compound oxide containing nickel or cobalt. Among oxides to be contained in the coating of the electrode of the present invention, nickel oxide is most preferred. Cobalt oxide is suitable for the purpose of the present invention. However, detailed comparison between nickel oxide and cobalt oxide shows that nickel oxide is excellent in activity as compared with cobalt oxide.

In the present invention, the chromium component may be chromium metal per se or an oxide thereof. The titanium component may be titanium metal per se or an oxide thereof. The chromium and titanium components may be in a state of a solid solution with an oxide of at least one metal selected from the group consisting of nickel and cobalt, or may be in an amorphous state thereby to form a mixture with the oxide of at least one metal selected from nickel and cobalt. Moreover, the chromium and titanium components may be in a state of a compound oxide with at least one metal selected from the group consisting of nickel and cobalt. Of the above-mentioned various states, it is preferred in the present invention that at least portion of the chromium and titanium components be in a state of a solid solution with an oxide of nickel or cobalt or in an amorphous state thereby to form a mixture with the oxide of nickel or cobalt. Presence of the solid solution in the coating can be confirmed by studying the X-ray diffraction pattern of the coating. That is, for example in the case where the coating contains a nickel oxide, the peak attributed to the solid solution of NiO is observed, on the diffraction pattern of the coating, in a position slightly deviated from that of the peak attributed to the pure form of NiO. Also, whether the chromium and titanium components are in an amorphous state can be confirmed by studying the X-ray diffraction pattern of the coating. That is, when they are in an amorphous state, the peaks attributed to chromium and titanium are not observed.

It is preferred that the degree of oxidation of the coating of the electrode be in the range of from 20 to 99.5%. Coatings having a degree of oxidation of less than 20% are not suitable because they cause the activity of the electrode to decrease in a short period of time. With such coatings, a long life electrode, which is of the objectives of the present invention, cannot be obtained.

The term "degree of oxidation" used herein is intended to indicate the value (%) of the formula $$\frac{H_1}{H_1 + H_0} \times 100 \quad (3)$$

wherein $H_0$ represents the height of peak of the highest intensity X-ray diffraction line of a metal when the coating is analyzed by X-ray diffractometry, or represents the sum of the heights of peaks of the highest intensity X-ray diffraction lines of individual metals in case the coating contains a plurality of metals; and $H_1$ represents the height of peak of the highest intensity X-ray diffraction line of a metal oxide, or represents the sum of the heights of peaks of the highest intensity X-ray diffraction lines of individual metal oxides in case the coating contains a plurality of metal oxides.

Next, with respect to the method of forming a coating on an electrically conductive substrate in the present invention, there may be employed various techniques. An example of the methods is one in which a homogeneous solution is prepared of a salt of at least one metal selected from nickel and cobalt, which salt can be decomposed to form an oxide, and salts of chromium and titanium, and the solution is applied onto an electrically conductive substrate, followed by baking in an oxygen-containing atmosphere. Another example of the methods is one in which a powdery raw material comprised of a mixture of an oxide of at least one metal selected from nickel and cobalt or a metal or metal compound capable of forming such an oxide and oxides of chromium and titanium or those metals or metal compounds which are capable of forming such oxides is applied onto a substrate by melt-spraying such as plasma spraying and flame spraying. A further example of the methods is one in which a substrate is subjected to electroplating and/or chemical plating in a homogeneous solution containing a salt of at least one metal selected from nickel and cobalt and salts of chromium and titanium, followed by oxidative-calcination in an oxygen-containing atmosphere.

In the above-mentioned method comprising applying a homogeneous solution of metal salts followed by baking, examples of the suitable salts of nickel, cobalt, chromium and titanium are nitrate, chloride, formate, acetate and oxalate salts of such metals.

In the above-mentioned method comprising melt-spraying, examples of the suitable powder include oxides, hydroxides, carbonates, formates and/or oxalates of nickel, cobalt, chromium and titanium and/or such metals per se. Of them, powders of oxides of such metals are most preferable.

In the above-mentioned method comprising electroplating and/or chemical plating followed by oxidative-calcination, suitable examples of the salts of nickel, cobalt and chromium are sulfate, chloride, nitrate, acetate and trichloroacetate salts of such metals.

Of these method, the method comprising melt-spraying is most preferable, for it ensures complete coating with a predetermined composition and gives an electrode having a high activity which can be utilized for a prolonged period of time. Illustratively stated, according to this method, the operations of melting of the powder and solidification and coating formation of the melted material on the substrate can be accomplished instantaneously. Hence, a non-stoichiometric composition tends to be formed. This is believed to be the reason why an electrode coating having a high activity can be obtained by melt-spraying. Moreover, a uniform composition of a plurality of components may be obtained with certainty by the use of relatively easy and secure techniques, such as mixing and granulation. By melt-spraying such a uniform composition, it is possible to obtain the desirable electrode coating freely. Therefore, the melt-spraying method is one of the most suitable methods for the purpose of the present invention, which is to provide a hydrogen-evolution electrode, with a coating of a plurality of components thereon, having a high activity and long life.

Accordingly, in another aspect of the present invention, there is provided a method of producing a hydrogen-evolution electrode which comprises:

(1) forming a mixture of a finely divided powder of at least one member selected from the first group consisting of nickel, cobalt, oxides of nickel and cobalt, hydroxides of nickel and cobalt, organic acid salts of nickel and cobalt and inorganic acid salts of nickel and cobalt, a finely divided powder of at least one member selected from the second group consisting of chromium, an oxide of chromium, a hydroxide of chromium, an organic acid salt of chromium and an inorganic acid salt of chromium, and a finely divided powder of at least one member selected from the third group consisting of titanium, an oxide of titanium, a hydroxide of titanium, an organic acid salt of titanium and an inorganic acid salt of titanium, and (2) applying the obtained mixture onto an electrically conductive substrate by melt spraying.

With respect to the melt-spraying method, it is important to improve the affinity between the active material of the electrode and the material giving reduction resistance thereto so that they may fully exhibit their respective functions. This is so from the viewpoint of attaining the purpose of the present invention which is to provide a hydrogen-evolution electrode having a high activity and long life. For the foregoing reason, it is preferred that the starting powders of the material giving electrode activity and the material giving reduction resistance thereto be sufficiently mixed, milled and formed into granules before being subjected to melt-spraying.

Various granulation techniques may be employed. They may be classified into several categories according to the type of apparatus, the state of starting material, the granule-forming mechanism or the like. For example, the granulation of powder may be carried out by means of a rotary drum-type apparatus or rotary dish-type apparatus in which a mixture of powder and liquid is formed into granules due to capillary absorption action and/or chemical reaction. It may also be carried out by means of a spraying and drying-type apparatus in which a material in the form of solution or suspension is formed into granules due to surface tension, drying and crystallization. Further, it may be carried out by means of a spraying and air cooling-type apparatus or spraying and water cooling-type apparatus in which a molten material is formed into granules due to surface tension, cooling and crystallization. Any of the above-cited granulation techniques provide substantially spherical granules. Of the above-cited granulation techniques, that by means of a spraying and drying-type apparatus is most preferable because it has some advantages, such as facilitating the application of an active coating since uniformly porous granules are obtained, formation of well-bonded granules, facility in granules size control and low cost.

Some detailed explanation is given below with respect to the granulation technique by means of a spraying and drying-type apparatus. According to the method, a homogeneous suspension or solution may first be prepared from a powder, binding agent and water. Second, the suspension or solution may be sprayed through a rotary disc, two-channel nozzle, pressure nozzle or the like to form liquid droplets. Third, the liquid droplets may be dried, thereby to obtain granules having a uniform composition, uniform shape and uniform size in which the components are bonded with uniform bonding strength.

As the suitable binding agent to be employed for preparing granules, there may be mentioned water-soluble polymeric organic substances, such as polyvinyl alcohol, polyvinyl acetate, gum arabic, carboxymethyl cellulose, methyl cellulose, ethyl cellulose and the like. These polymeric organic substances serve as the binding agent for component powder materials during the granule-forming stage whereby to provide granules of which the components are bonded with certain bonding strength. During the melt-spraying stage, however, they almost completely disappear due to combustion or decomposition so that they exert no adverse effect on the resulting coating over the electrode.

To stabilize the above-mentioned suspension or solution to be employed in the granulation for the purpose of obtaining uniform granules, there may be added a dispersant, antiflocculating agent, surfactant, antiseptic and the like. In selecting these agents, the most suitable types must be selected which exert no adverse effect on the active coating over the electrode. As examples of the dispersant, there may be mentioned a sodium salt of carboxymethyl cellulose having a molecular weight of $200\times10^3$ or more, methyl cellulose having a molecular weight or $140\times10^3$ or more, polyethylene glycol having a molecular weight of $120\times10^3$ or more and the like. As examples of the antiflocculating agent, there may be mentioned sodium hexametaphosphate, ammonium citrate, ammonium oxalate, ammonium tartrate, monoethylamine and the like. As examples of the surfactant, there may be mentioned alkyl aryl phosphates, alkyl aryl sulfonate, fatty acid soap and the like. As examples of the antiseptic, there may be mentioned sodium phenoxide, phenol, phenol derivatives, formaldehyde and the like. Generally, it is preferred that the powder material concentration of the suspension or solution be in the range of from 30 to 90% by weight.

The size of the granules to be employed in the granulation technique by means of a spraying and drying-type apparatus may be in the range of preferably from 1 to 200 μm, more preferably from 5 to 100 μm. When the granule size is too small, especially less than 1 μm, a large volume of dust occurs during the melt-spraying stage. This markedly lowers melt-spraying yield, thereby causing performance of melt-spraying on a commercial scale to be difficult. On the other hand, when the granule size is too large, especially more than 200 μm, there occur problems, such as degradation of electrode activity, shortening of electrode life, decrease in coating strength and fall of melt-spraying yield which are primarily attributed to incomplete melting of the material.

It is preferred that the granules have a crushing strength of 0.5 g/granule or more. Such a level of crushing strength is needed to maintain their morphology during the storage and transportation after the granule formation. The crushing strength of the granules can be varied by changing the amount and/or kind of the binding agent to be employed.

As the suitable method for melt-spraying the granules, there may be mentioned, for example, flame spraying and plasma spraying. Of the above-cited techniques, plasma spraying is more preferable.

Some detailed explanation is given below with respect to the plasma spraying method. According to the method, dissociation and ionization of at least one kind of gas selected from argon, nitrogen, hydrogen, helium and other gases may be caused to occur by passing the gas through a direct-current arc slit. This enables a plasma flame having such a high temperature as several thousand to more than ten thousand degrees centigrade, a certain heat capacity and a high speed to be taken out. The granules may be conveyed by an inert gas and poured in the plasma flame. The granules poured in the plasma flame will melt fly and collide against the surface of the electrode substrate. Then, the molten material on the electrode substrate may be cooled and solidified, thereby to form a coating on the substrate. The above-mentioned melting, flight and collision of the material may be accomplished instantaneously, for example, generally in a period of from 0.1 to 10 milliseconds. The temperature, heat capacity and speed of the plasma flame primarily depend on the kind of the gas employed and the power of the arc. As the suitable gas to be employed for producing the plasma flame, there may be mentioned mixtures of gases, such as those of argon and nitrogen, argon and hydrogen, and nitrogen and hydrogen. The power of the arc is determined by the arc current and arc voltage. The arc voltage, at a fixed arc current, depends on the inter-electrode distance and the kind and flow rate of plasma gas. When a gas requiring much energy for dissociation and ionization of molecules, such as nitrogen, is employed, the arc voltage generally tends to increase. On the other hand, when a gas which consists of single-atom molecules and can be readily ionized, such as argon, is employed, the arc voltage generally tends to decrease. At any rate, the power of the arc must be sufficient to provide a plasma flame having a temperature and heat capacity enough to accomplish the above-mentioned melting of the powder material in the form of granules instantaneously.

As the other conditions affecting the melt-spraying, there may be mentioned the distance from the spray nozzle to the substrate to be spray coated and the angle at which the spray nozzle is disposed with respect to the face of the substrate to be spray coated. Generally, the distance from the spray nozzle to the substrate to be coated is preferably 50 to 300 mm, and the angle at which the spray nozzle is disposed with respect to the substrate to be coated is preferably 30° to 150°. Further, the method for pouring the granules in the plasma flame and the method for cooling the melt-sprayed material may affect the melt-spraying. However, these conditions are not of critical nature and may be chosen from the conditions customarily employed.

In addition to the above-mentioned components, a fourth component selected from zinc, zinc oxide, aluminum, silicon dioxide, molybdenum, molybdenum oxide and other substances may be incorporated in the granules. This is advantageous, for it further improves the activity of the resulting electrode and further decreases the hydrogen overvoltage.

The preferred thickness of the coating of electrode is 10 to 300 μm. Where the thickness of the coating is less than 10 μm, there cannot be obtained an electrode exhibiting a satisfactorily lowered hydrogen overvoltage. On the other hand, the increase in thickness of the coating to more than 300 μm is not advantageous from an economical viewpoint because even if the coating thickness is more than 300 μm, the hydrogen overvoltage is not lowered beyond a certain value.

Explanation will now be made on an electrically conductive substrate to be used for preparing the hydrogen-evolution electrode of the present invention. The electrically conductive substrate of electrode should be sufficiently resistant to an electrolytic solution not only at a potential of the substrate during the electrolysis but also at a potential of the substrate at the time when the electrolysis is not effected. The surface of a substrate having an active, porous coating thereon has a potential which is noble as compared with the potential on the surface of the coating even during a period of time in which hydrogen is evolved from the surface of the coating of the electrode. Therefore, it is not unusual that the potential at the surface of the substrate is noble as compared with the dissolution-deposition equilibrium potential of iron. For this reason, in case iron is used as the substrate of electrode, the iron is corroded and dissolved out from the surface of the substrate. As a result, the electrolytic solution and the electrode coating are contaminated and, in an extreme case, the coating of electrode is caused to be exfoliated from the substrate so that the activity of the electrode is greatly decreased. As examples of the material which has an anticorrosive property sufficient for use as the substrate of electrode of the present invention and is commercially available, there may be mentioned, for example, nickel, a nickel alloy, an austenite type stainless steel, a ferrite type stainless steel and the like. Of the above-mentioned materials, nickel, a nickel alloy and an austenite type stainless steel are preferred, and nickel and a nickel alloy are particularly preferred. Besides, those which each are composed of an electrically conductive substrate having on its surface a non-pinhole coating of nickel, a nickel alloy or an austenite type stainless steel may also preferably be used as the substrate of electrode. Such a non-pinhole and anticorrosive coating may be obtained by known techniques, for example, electroplating, chemical plating, melt-plating, rolling, pressure-adhesion by explosion, cladding, vapor deposition, ionization plating and the like.

The preferred shape of the substrate of electrode is of such a structure that hydrogen gas generated during the electrolysis is smoothly released so that a superfluous voltage loss due to the current-shielding by the hydrogen gas may be avoided and that the effective surface area for electrolysis is large so that the current is hardly concentrated. The substrate having such a shape as mentioned above may be made of a wire screen having a suitable wire diameter and spacing between the mutually adjacent wires, a perforated metal plate having a suitable thickness, size of openings and pitch of opening arrangement, an expanded metal having suitable lengths of long axis and short axis, or the like.

The electrode of the present invention can be effectively used as a hydrogen-evolution electrode in the electrolysis of sodium chloride by the ion exchange membrane process or the diaphragm process, electrolysis of alkali metal halides other than sodium chloride, electrolysis of water, electrolysis of Glauber's salt and the like. It is preferred that an electrolytic solution to be in contact with the electrode of the present invention be alkaline. The type of an electrolytic cell to be used together with the electrode of this invention may be of either monopolar arrangement or bipolar arrangement. When the electrode of the present invention is used in the electrolysis of water, it may be used as a bipolar electrode.

According to the present invention, dissolution out of the chromium component contained in the coating of an electrode can be suppressed. Therefore, the present invention provides an electrode which has a service life several times as long as that of a conventional electrode and exhibits low hydrogen overvoltage even after the electrode is used for a long period of time. Further, since the dissolution-out of the chromium component into the aqueous alkaline solution can be decreased in the present invention, the purity of the electrolysis product can be increased.

The present invention will be further illustrated in more detail with reference to the following Examples which should not be construed to be limiting the scope o the present invention.

In Examples, various measurements were made as follows. The contents of a chromium component and a titanium component in the coating of an electrode (hereinafter often referred to as "chromium component content" and "titanium component content") are determined by the ICAP (inductively coupled argon plasma emission spectrophotometer) method as follows.

One part by weight of the coating of an electrode is mixed with 50 parts by weight of a flux (a mixture of 2 parts by weight of sodium peroxide and one part by weight of sodium carbonate) and the resulting mixture is calcined at a temperature of 600° C. or more. A predetermined amount of hot water and aqueous 50% sulfuric acid are added to the resulting mixture to obtain a homogeneous solution. The obtained solution is used as the sample. The experimental conditions and apparatus used are as follows.

| Kind of atom | Wave length (nm) | Apparatus |
|---|---|---|
| Ni | 221.647 | ICAP-575 type Mark II (manufactured and sold by Nippon Jarrell-Ash Co. Ltd., Japan) |
| Cr | 205.552 | ICAP-575 type Mark II (manufactured and sold by Nippon Jarrell-Ash Co. Ltd., Japan) |
| Ti | 334.941 | ICAP-575 type |

-continued

| Kind of atom | Wave length (nm) | Apparatus |
|---|---|---|
| | | Mark II (manufactured and sold by Nippon Jarrell-Ash Co. Ltd., Japan) |

The following values are obtained as follows.

Diameter of granules

The electron microscopic method

Water content of granules

The infrared drying method

Spraying yield $$\text{Spraying yield (\%)} = \frac{\text{Weight of electrode (g)} - \text{Weight of substrate (g)}}{\text{Amount of powder supplied (g)}} \times 100$$

Crushing strength

Granules having a diameter of 30–44 μm are classified by means of a sieve. The minimum load (g) to crush a granule is determined with respect to 30 granules. The obtained values of load (g) are averaged.

Degree of oxidation

X-ray diffractometry

EXAMPLE 1

100 Parts by weight of powder nickel oxide (NiO) having particle diameters ranging from 0.2 to 2 μm, 5.7 parts by weight of powder chromium oxide ($Cr_2O_3$) having particle diameters ranging from 0.5 to 3 μm and 2.3 parts by weight of powder titanium oxide ($TiO_2$) having particle diameters ranging from 1 to 10 μm were added to an aqueous solution consisting of 100 parts by weight of water, 2.25 parts by weight of gum arabic as a binder, 0.7 part by weight of sodium carboxymethyl cellulose as a dispersant, 0.001 part by weight of sodium lauryl sulfate as a surfactant and 0.1 part by weight of phenol as an antiseptic agent. The resulting mixture was vigorously stirred to obtain a homogeneous suspension.

The thus obtained suspension was dried and granulated by means of a spray dryer type granulation chamber (hereinafter often referred to simply as "granulation chamber") having a diameter of 1 m and a height of 0.7 m and equipped at its top with a rotating disc. In this step, the suspension was fed to the granulation chamber at the rotating disc being rotated at 25,000 r.p.m. at a feed rate of 40 kg/hr by means of a pump, whereby the suspension became drop lets and was dispersed while being subjected to gravity-drop toward the bottom of the granulation chamber. A hot air of 330° C. was fed to the granulation chamber so that the hot air flows in the same direction as the dispersed droplets fell. The flow rate of the hot air was adjusted so that the hot-air temperature was 120° C. at the outlet of the hot air located at the side portion of the bottom of the granulation chamber. Spherical granules having temperatures of 95° to 100° C. were produced at a production rate of about 18 kg/hr. The produced granules were taken out from the bottom of the granulation chamber and allowed to stand for cooling. The obtained granules were 5 to 50 μm in diameter as determined by the electron microscopic method, 5 g/granule in crushing strength and less than 0.1% in water content.

A 5 cm×5 cm nickel wire screen (wire diameter, 0.7 mm; 12 mesh) was degreased with trichlene, and then blasted by means of $Al_2O_3$ having a particle size of 0.73 to 2.12 mm. The blasted wire screen(substrate) was melt spray coated on each side thereof with the above-prepared granules by plasma spraying as indicated below. The plasma spraying was repeated 3 times with respect to each side of the wire screen to produce an electrode having a coating of a thickness of 100 μm with respect to the front side of the wire screen and 50 μm with respect to the back side of the wire screen.

Plasma spraying was done using the following average spraying parameters.

Feeding rate of plasma gas of argon and nitrogen: 1 $m^3$ (at normal state)/hr and 0.8 $m^3$ (at normal state)/hr, respectively Feeding rate of granules to plasma flame from a

| | |
|---|---|
| hopper (carrier gas: argon): | 5.0 kg/hr |
| Plasma arc (current): | 700 A |
| Voltage between electrodes: | about 50 V |
| Distance between substrate and spray gun (spray distance): | 10 cm |
| Angle of the plasma flame relative to the face of the substrate: | 90° |

The spraying yield of the granules was 60%, that is, the granules were coated on the substrate at a rate of 3.0 kg/hr.

Figure 3:
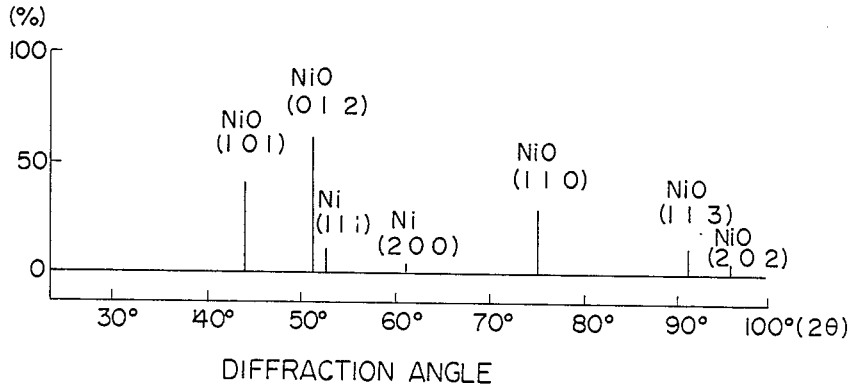
FIG. 3 shows an X-ray diffraction pattern of an electrode coating comprising a nickel oxide, chromium and titanium of which the contents of chromium component and titanium component in the coating are 5.2% and 2.0% in terms of atomic percentage, respectively.

The resulting electrode was analyzed by X-ray diffractometry to determine the degree of oxidation of the coating by calculation from a height of the peak attributed to crystal face (012) with respect to NiO and a height of the peak attributed to crystal face (111) with respect to Ni, respectively. The value of degree of oxidation [NiO/(NiO+Ni) (x100)] of the coating was 90% but not 100%. This is due to partial reduction of nickel oxide in the plasma flame. The peaks attributed to chromium oxide, chromium per se, titanium oxide, titanium per se, a compound oxide of nickel-chromium ($NiCr_2O_4$) and a compound oxide of nickel-titanium ($NiTiO_2$) in the coating were not detected. Further, assuming that NiO was in the form of a cubic crystal, the lattice constant of NiO was calculated from the positions of the peaks attributed to NiO. As a result, the lattice constant was found to be 4.175 Å. On the other hand, substantially the same procedures as mentioned above were repeated to prepare another electrode, except that only powder nickel oxide was used instead of the combination of powder nickel oxide, powder chromium oxide and powder titanium oxide. The obtained electrode was analyzed by X-ray diffractometry and the lattice constant of NiO in the coating of the electrode was calculated in the same manner as mentioned above. As a result, the lattice constant was found to be 4.180 Å. Therefore, it is considered that the chromium component and the titanium component are present in nickel oxide in the form of a solid solution or in an amorphous form. The chromium component content and the titanium component content of the coating were 5.3% and 2.0%, respectively. The X-ray diffraction pattern of the coating of the electrode is shown in FIG. 3.

There was provided an electrolytic cell which is partitioned by a carboxylic acid-sulfonic acid type cation exchange membrane composed of two kinds of stratums commercially available under the trade name "Aciplex" (manufactured and sold by Asahi Kasei Kogyo K.K., Japan) into a cathode chamber and an anode chamber accommodating therein an anode made of a titanium-made expanded metal having thereon a coating composed of ruthenium oxide, zirconium oxide and titanium oxide. The above-obtained electrode was installed in the cathode chamber of the electrolytic cell in such a manner that the surface of the front side of the electrode faced the carboxylic acid stratum of the cation exchange membrane. While supplying brine having a NaCl concentration of 175 g/liter into an anode chamber and supplying a 30% aqueous sodium hydroxide solution into a cathode chamber, electrolysis was continuously conducted at a current density of 40 A/dm$^2$ and at 90° C. The hydrogen overvoltage was measured by the current interrupt method and in such a manner in which Luggin capillary was connected to a reference electrode (Hg/HgO;25° C.) by means of liquid-junction and in turn was connected to the surface of the cathode facing the cation exchange membrane.

The electrolysis was continued for 20 months to observe the changes in the hydrogen overvoltage, chromium component content and degree of oxidation.

TABLE 1

| | At initial stage | After 20 months |
|---|---|---|
| Hydrogen Overvoltage (40 A/dm$^2$) | 150 mV | 140 mV |
| Chromium component content | 5.3% | 4.7% |
| Degree of oxidation* | 90% | 72% |

Note:
* $\frac{NiO}{NiO + Ni} \times 100$

EXAMPLES 2 TO 10 COMPARATIVE EXAMPLES 1 TO 5

Substantially the same procedures as in Example 1 were repeated to obtain homogeneous suspensions, except that powder nickel oxide (NiO) having particle diameters ranging from 0.2 to 2 μm, power chromium oxide ($Cr_2O_3$) having particle diameters ranging from 0.5 to 3 μm and powder titanium oxide ($TiO_2$) having particle diameters ranging from 1 to 10 μm were added to the aqueous solution in a variety of amounts.

Using the thus obtained suspension, drying and granulation, and plasma spraying were effected in substantially the same manner as in Example 1 to prepare electrodes bearing coatings thereon having various compositions, i.e. nickel oxide-chromium-titanium type coating electrodes, nickel oxide-chromium type coating electrodes and a nickel oxide-titanium type coating electrode.

The chromium component content and the titanium component content of the coating of each electrode as prepared above are shown in Table 2. The degree of oxidation [NiO/(NiO+Ni) (×100)] of the coating of the above-prepared electrodes as measured by X-ray diffractometry was in the range of from 87 to 94%.

Substantially the same procedures as in Example 1 were repeated to effect electrolyses for evaluation of the performance of electrode, except that each electrode as prepared above was used.

The results are shown in Table 2.

TABLE 2

| | At initial stage | | | After 20 months | | |
|---|---|---|---|---|---|---|
| | Chromium component content % | Titanium component content % | Hydrogen overvoltage, mV (at 40A/dm$^2$) | Chromium component content % | Hydrogen overvoltage, mV (at 40A/dm$^2$) | Oxidation degree |
| Example - 2 | 4.9 | 0.2 | 150 | 3.8 | 140 | 62 |
| Example - 3 | 5.0 | 0.5 | 150 | 4.1 | 140 | 70 |
| Example - 4 | 5.1 | 3.5 | 150 | 4.3 | 140 | 68 |
| Example - 5 | 5.1 | 5.0 | 150 | 4.2 | 140 | 68 |
| Example - 6 | 4.9 | 9.9 | 175 | 4.0 | 160 | 72 |
| Example - 7 | 10.1 | 2.1 | 150 | 9.1 | 140 | 74 |
| Example - 8 | 19.9 | 2.0 | 160 | 18.0 | 140 | 73 |
| Example - 9 | 39.0 | 2.1 | 235 | 32.5 | 210 | 75 |
| Comparative Example - 1 | 4.9 | 0 | 150 | 2.4 | 240 | 16 |
| Comparative Example - 2 | 19.5 | 0 | 160 | 11.0 | 140 | 42 |
| Comparative Example - 3 | 0 | 2.0 | 150 | 0 | 230 | 19 |
| Comparative Example - 4 | 5.0 | 12.0 | 260 | 4.1 | 230 | 69 |
| Comparative Example - 5 | 47.0 | 2.0 | 240 | 40.0 | 220 | 77 |
| Example - 10 | 0.5 | 2.0 | 150 | 0.2 | 180 | 28 |

What is claimed is:

1. A hydrogen-evolution electrode comprising an electrically conductive substrate having thereon a coating comprising a chromium component, a titanium component and an oxide of at least one metal selected from the group consisting of nickel and cobalt, said chromium component and titanium component being present in proportions, in term of atomic percentage, of 0.5 to 20% and 0.1 to 3.5%, respectively, the said atomic percentage of chromium being defined by following formula $$\frac{A_{Cr}}{A_T} \times 100(\%) \quad (1)$$

wherein $A_{Cr}$ represents the number of chromium coating and $A_T$ represents the total number of atoms of chromium, titanium and said at least one metal in the coating, said atomic percentage of titanium being defined by the following formula $$\frac{A_{Ti}}{A_T} \times 100(\%) \quad (2)$$

wherein $A_{Ti}$ represents the number of titanium atoms in the coating and $A_T$ is as defined above.

2. An electrode according to claim 1, wherein said electrically conductive substrate is comprised of an anticorrosive material selected from the group consisting of nickel, a nickel alloy, and an austenite type stainless steel.

3. An electrode according to claim 1, wherein said coating comprises a nickel oxide, chromium and titanium.

4. An electrode according to claim 1, wherein said coating has a degree of oxidation of 20 to 99.5%, said degree of oxidation being defined by the formula $$\frac{H_1}{H_1 + H_0} \times 100(\%) \quad (3)$$

wherein $H_0$ represents the height of peak of the highest intensity X-ray diffraction line of a metal when the coating is analyzed by X-ray diffractometry, or represents the sum of the heights of peaks of the highest intensity X-ray difraction lines of individual metals in case the coating contains a plurality of metals; and $H_1$ represents the height of peak of the highest intensity X-ray diffraction line of a metal oxide, or represents the sum of the heights of peaks of the highest intensity X-ray diffraction lines of individual metal oxides in case the coating contains a plurality of metal oxides.

* * * * *